US006831414B2

(12) United States Patent
Van Erk et al.

(10) Patent No.: US 6,831,414 B2
(45) Date of Patent: Dec. 14, 2004

(54) HIGH-PRESSURE GAS DISCHARGE LAMP

(75) Inventors: Willem Van Erk, Eindhoven (NL); Arnoldus Henricus Franciscus Maria Toonders, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 268 days.

(21) Appl. No.: 10/140,501

(22) Filed: May 7, 2002

(65) Prior Publication Data

US 2003/0001502 A1 Jan. 2, 2003

(30) Foreign Application Priority Data

May 10, 2001 (EP) ..... 01201723

(51) Int. Cl.[7] ..... H01J 17/18
(52) U.S. Cl. ..... 313/623; 313/626; 313/637
(58) Field of Search ..... 313/620, 623, 313/624, 625, 626, 637

(56) References Cited

U.S. PATENT DOCUMENTS 4,001,626 A 1/1977 Drop et al.
4,935,668 A 6/1990 Hansler et al.
5,479,065 A 12/1995 Sugimoto et al.
5,592,050 A 1/1997 Higashi et al.
5,965,984 A 10/1999 Horiuchi et al.
6,069,456 A 5/2000 Fromm et al.

FOREIGN PATENT DOCUMENTS

DE 2455277 A1 6/1975
EP 0605248 A2 7/1994

*Primary Examiner*—Vip Patel
(74) *Attorney, Agent, or Firm*—Ernestine C. Bartlett

(57) ABSTRACT

The high-pressure discharge lamp (1) comprises a lamp vessel (2) having a wall (3) which is exposed to a wall load of at least 30 W/cm$^2$ during operation of the lamp, and a discharge space (4) in which a electrodes (5*a*, 5*b*) are disposed. The discharge space (4) has a filling that comprises mercury, argon, and halides (not fluoride) of tin and indium, to which filling an alkali halide is added, the alkali being potassium, rubidium, or cesium, and the halide being chlorine, bromine, or iodine. The high-pressure discharge lamp (1) according to the invention has an improved resistance to corrosion and to crystallization of the quartz glass wall (3) because of shielding or spacer means (8) by which a direct contact between electrode rods (30) and the wall (3) of the lamp vessel (2) is counteracted.

10 Claims, 1 Drawing Sheet

HIGH-PRESSURE GAS DISCHARGE LAMP

FIELD OF INVENTION

The invention relates to a high-pressure gas discharge lamp comprising:

a quartz glass lamp vessel with a space which is enclosed in a gastight manner by a wall, said wall comprising mutually opposed seals and an inner surface;

a pair of electrodes arranged opposite to one another in said space, each electrode comprising a tip and an electrode rod, and each electrode being connected to a respective current lead-through which extends through a respective seal to the exterior;

an outer surface of the wall extending between the seals, the wall having a wall load of at least 30 W/cm$^2$ at its outer surface during stable lamp operation;

a filling inside the space comprising a rare gas and halides of tin and indium, said filling comprising an alkali halide with at least one alkali ion and at least one halide ion, said alkali ion being chosen from the group formed by potassium, rubidium, and cesium, and said halide ion being chosen from the group formed by chlorine, bromine, and iodine.

BACKGROUND OF THE INVENTION

Such a high-pressure gas discharge lamp is described in our co-pending application U.S. Ser. No. 09/709,265, filed Nov. 9, 2000 and the patent document EP-9920377.5 not previously published. The lamp vessel is manufactured from quartz glass, i.e. glass with an $SiO_2$ content of at least 95% by weight. Major portions of the wall have a temperature higher than 1050 K in the case of lamps having a comparatively high wall load on the outer surface of the wall of at least 30 W/cm $^2$. A wall load of 30 W/cm$^2$ occurs in lamps which have a short discharge arc, for example with a length of at most 10 mm. To obtain a practically useful luminous flux from lamps having such a short discharge arc, a comparatively high pressure is often present during operation in the space of the lamp vessel so as to obtain a required lamp voltage. The comparatively high pressure in the lamp leads to a strong convection, so that locally a high temperature prevails in the wall of the lamp vessel, often a temperature of more than 1325 K. The risk of corrosion and/or crystallization of the wall of the lamp vessel is considerably increased at such high temperatures. An unacceptably fast corrosion and/or crystallization of the wall of the lamp vessel caused by local heating owing to convection is counteracted in the described lamp through the choice of a filling ingredient. The risk of corrosion, however, still remains comparatively high in locations where the electrode rods, which extend from the enclosed space into the wall, make contact with the wall adjacent the inner surface of the wall. This generally results in a comparatively high risk of explosion of the lamp vessel, and thus in a comparatively short lamp life, in the known high-pressure gas discharge lamp.

SUMMARY OF THE INVENTION

It was found in experiments that the risk of explosion of the lamp vessel of the described lamp owing to corrosion and/or crystallization is reduced if the electrode rod of at least one of the electrodes is provided with spacer means at the area of the inner surface of the wall, such that a capillary opening is realized which surrounds the electrode rod and is present between the electrode rod and the spacer means. When the seals of the lamp are manufactured, the electrode rod together with the spacer means provided around it is embedded in the wall of the lamp vessel through a temporary local softening of the quartz glass. The spacer means counteract that the softened quartz glass comes into contact with the electrode rod. The softened quartz glass as a result will not adhere to the electrode rod but to the spacer means. The quartz glass and the metal electrode rod have a difference in coefficient of expansion, which coefficients are approximately $5\times10^{-7}$ $K^{-1}$ and approximately 40 to $50\times10^{-7}K^{-1}$, respectively. This difference in coefficient of expansion leads to a difference in shrinkage upon cooling down, and accordingly to a difference in the change in shape between the quartz glass and the metal electrode rod. The quartz glass becomes rigid upon cooling down, and the electrode rod will shrink more than the quartz glass, whereby the said capillary opening between the spacer means and the electrode rod is created. The comparatively good adhesion between the quartz glass and the spacer means and a comparatively low mechanical strength of the spacer means will cause the spacer means to adapt to the change in shape of the quartz glass. Suitable spacer means are, for example, a foil or a coil manufactured from a material chosen from the group formed by tungsten, molybdenum, tantalum, rhenium, and combinations thereof. The provision of the spacer means on the electrode rod, for example in the form of a coiling, achieves that the wall of the lamp vessel assumes a comparatively low temperature adjacent the location where the electrode rod extends from the seal of the wall into the space. Heating-up of the wall of the lamp vessel during lamp operation is caused inter alia by thermal conduction between the electrode rod to the wall. The capillary opening counteracts an efficient, but potentially detrimental thermal conduction from the electrode rod to the wall of the lamp vessel.

The electrode rod, which extends over a length L inside the wall of the lamp vessel, is preferably provided with spacer means over the full length L. The capillary opening is then present over substantially the entire length L around the electrode rod. This achieves that the potentially detrimental thermal conduction between the electrode rod and the wall is counteracted further during lamp operation in that said thermal conduction takes place in a location situated farther away from the inner surface of the lamp vessel. It is achieved thereby that the wall assumes a yet lower temperature.

In an embodiment of the high-pressure gas discharge lamp, the high-pressure gas discharge lamp is a DC lamp, one of the electrodes being a cathode. It was surprisingly found in experiments with potassium halide, rubidium halide, or cesium halide in the filling that these halides act as a gas-phase emitter. The gas-phase emitter reduces the temperature required for the cathode to supply electrons during lamp operation. Without an emitter, an electrode temperature of 3000 to 3600 K is found to be necessary for lamp currents of 4 to 8 A. In the presence of such a gas-phase emitter, however, such a current can be realized at an electrode temperature which is approximately 500 K lower. The fact that said halides act as gas phase emitters provides the advantage, especially in DC lamps, that the corrosion of the cathode, the so-called burning back, is substantially reduced. The discharge arc will increase in length comparatively slowly only owing to this reduced corrosion over lamp life, so that the discharge arc will have a comparatively high stability over a longer period of time.

It is especially the wall adjacent the electrode rod of the cathode which has a comparatively high risk of being weakened by corrosion or crystallization of the quartz glass in a DC lamp. The corrosion adjacent the cathode is caused during lamp operation by the comparatively high temperatures and a comparatively high concentration of impurities, i.e. positive ions such as lithium and sodium. Said positive ions are attracted by the cathode as a result of an electric field which is present during lamp operation. It was found that the spacer means for preventing a direct contact between the electrode rod and the wall of the lamp vessel are particularly effective in a DC lamp in which the spacer means are provided on the electrode rod of the cathode. An excessive heating of the wall adjacent the electrode rod of the cathode is counteracted thereby. A further improvement of the lamp can be achieved if the electrode rod is lengthened to the extent that the tip of the cathode is at least at a distance $T_b$ from the location where the electrode rod passes through the inner surface of the wall such that the outer surface adjacent said location assumes a comparatively low temperature during stable lamp operation. Premature failure of the lamp is further counteracted thereby.

A yet further improvement of the lamp can be achieved in that the tip of the electrode is manufactured from tungsten, while the electrode rod is manufactured from at least 25% rhenium by weight, and for the rest from tungsten, a so-called hybrid electrode. This was found to slow down the corrosion of the lamp vessel wall, so that the chance of a long lamp life is increased. This effect occurs especially if the measure is applied to the cathode.

In a favorable embodiment of the high-pressure gas discharge lamp, the alkali ion is potassium. Very good results were obtained in experiments especially with the use of potassium halide in the lamp. Lamps with potassium halide in the filling manifested hardly any traces of corrosion and crystallization of quartz glass after 1000 hours of operation. An additional advantage of these lamps is that a chemical attack on molybdenum foils, which are components of lead-through constructions through the wall of the lamp vessel connected to the electrodes, is strongly inhibited.

In an alternative embodiment of the high-pressure gas discharge lamp, the high-pressure gas discharge lamp comprises a reflector in which the lamp vessel is secured. It is of essential importance to obtain a large quantity of lumens on a projection screen, the screen lumens, when the lamp according to the invention is used in projection applications. The lamp vessel is for this purpose accommodated in the reflector for reflection and concentration of the light originating from the discharge arc. To obtain a large quantity of screen lumens, it is desirable for the discharge arc to be short during operation. The high-pressure gas discharge lamp according to the invention with a wall load on the outer surface of more than 30 W/cm$^2$ and with a length of the discharge arc of less than 3 mm was found to be highly suitable for projection applications. Lamps with a discharge arc length of more than 10 mm usually have a wall load lower than 30 W/cm$^2$, in which case the quantity of screen lumens obtainable from the lamp is too small for projection applications. At the same time, it is desirable for the discharge arc to be stable and to be located in, or at least closely adjacent a focus of the reflector. When the lamp vessel is fixed in the reflector, it is ensured in a simple manner that the discharge arc is positioned in the focus of the reflector. Very favorable conditions for an efficient reflection and beam concentration of the light, and accordingly a large quantity of screen lumens are obtained in this manner. Preferably, the lamp vessel is secured in the neck of the reflector by that side of the lamp vessel in which the cathode is located. This leads to a better removal of heat generated at the cathode. This was found to slow down the corrosion of the lamp vessel wall at the cathode side, so that the probability of a long lamp life is increased.

It should be noted that the use of rare earth halides in a high-pressure gas discharge lamp with a quartz glass lamp vessel is known inter alia from EP-A2-0 605 248. Rare earth halides are understood to be the halides of the elements with atom numbers 21, 39, and 57 to 71. The rare earth halides, however, are comparatively expensive and react readily with the quartz glass lamp vessel. As a result, a lamp with a rare earth halide in its filling also has the disadvantage of a fast corrosion and crystallization of the quartz glass lamp vessel.

DESCRIPTION OF THE DRAWINGS

An embodiment of the high-pressure gas discharge lamp according to the invention will be discussed in more detail below with reference to a diagrammatic drawing, in which.

EXAMPLE

Figure 1:
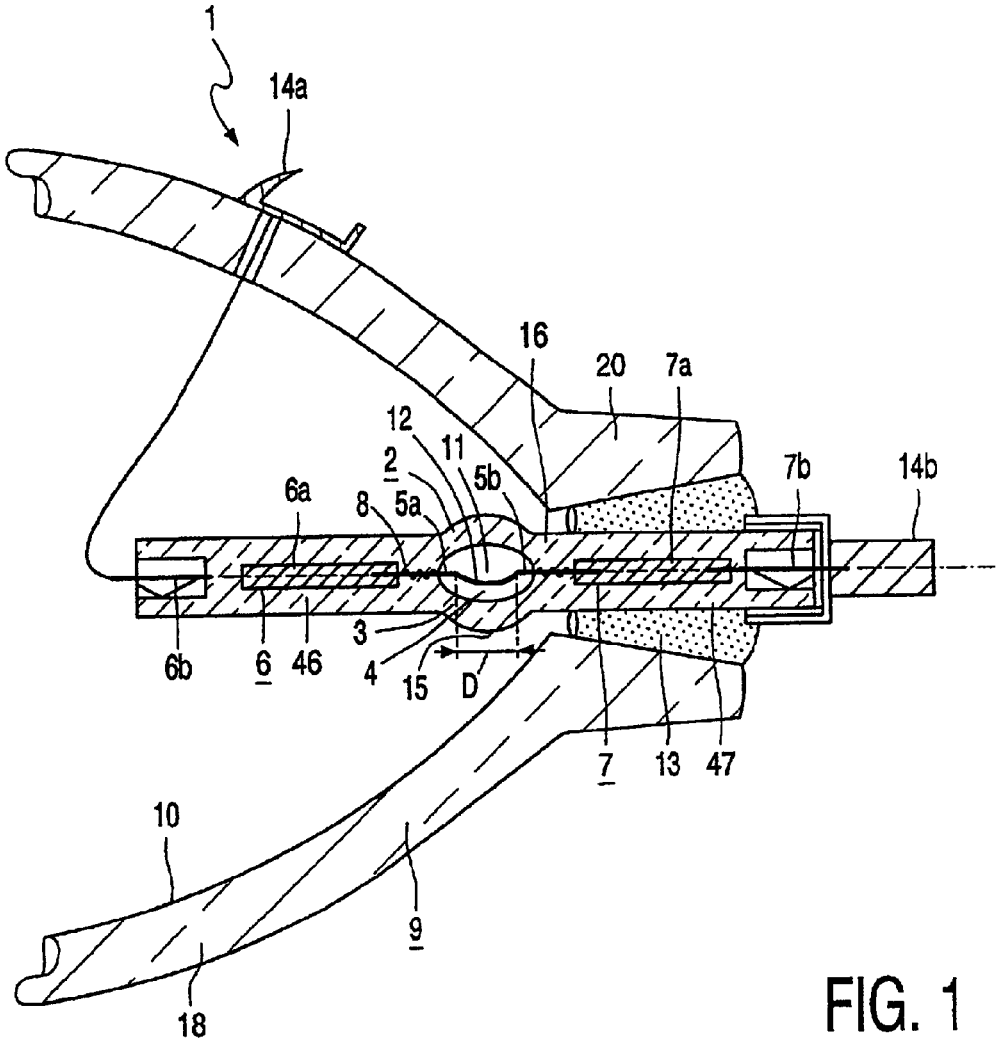
FIG. 1 is a cross-sectional view of an embodiment of the high-pressure gas discharge lamp according to the invention.

The high-pressure gas discharge lamp 1 of FIG. 1 is constructed as a DC lamp, but it may alternatively be constructed as an AC lamp, and comprises a quartz glass lamp vessel 2 with a wall 3 with two mutually opposed seals 46, 47, and with an outer surface 15 of approximately 10 cm$^2$ which extends between the two seals 46, 47, and also comprises a space 4 enclosed by the wall 3. Two electrodes, an anode 5*a* and a cathode 5*b*, are positioned in the space 4. The electrodes 5*a*, 5*b* in the Figure are enveloped by a tungsten coil 8. The electrodes 5*a*, 5*b* are each connected to a respective external contact point 14*a*, 14*b* via a respective lead-through 6, 7 comprising a molybdenum foil 6*a*, 7*a*, which is embedded in the wall 3 in a gastight manner, and via a respective external current conductor 6*b*, 7*b*. A filling comprising argon as a rare gas, mercury as a buffer gas, and tin bromide, indium bromide, and potassium bromide is present in the space 4. The lamp vessel 2 is provided in a concave elliptical reflector 9 in the high-pressure gas discharge lamp 1 shown. The reflector 9 has a neck 20 and a reflector portion 18 which is provided with a reflecting layer 10. The lamp vessel 2 is fixed in the neck 20 by means of cement 13 at a side 16 of the lamp vessel 2 in which the cathode 5*b* is present. The lamp vessel 2, however, may be fixed in alternative manners, for example clamped in, in a reflector of alternative shape, for example a parabolic reflector. The reflector 9 is open, but it may alternatively be closed off, for example with a lid. The reflector 9 has a focus 11. The high-pressure gas discharge lamp 1 shown is particularly suitable for use as a projection lamp and has a rated power of 400 W, a short electrode distance D of 2 mm, and a high pressure during lamp operation, for example of 60 bar. The lamp has a high wall load at the outer surface 15 of 40 W/cm$^2$. Because of the short electrode distance D and the high pressure, the lamp has a stable discharge arc 12 during operation, which arc is strongly contracted and lies mainly in or adjacent the focus 11 of the reflector 9.

Figure 2:
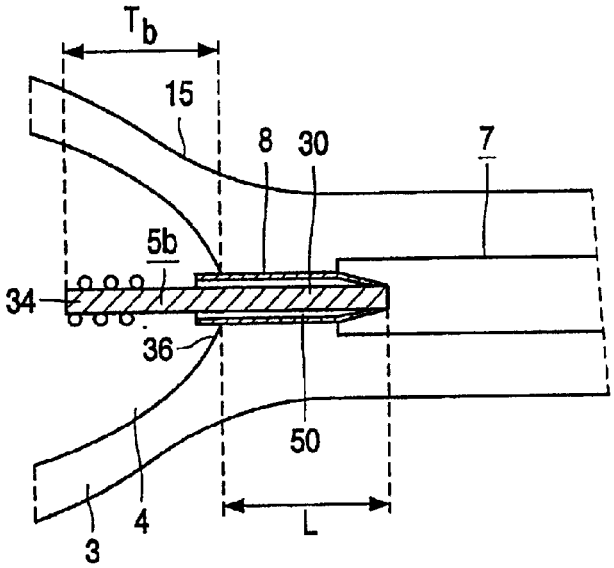
FIG. 2 shows a detail of the high-pressure gas discharge lamp according to the invention.

FIG. 2 shows the cathode 5*b* which has a tip 34 connected to an electrode rod 30 with a length L, which electrode rod 30 is surrounded by a molybdenum foil serving as spacer means 8 at the area where the electrode rod 30 passes through an inner surface 36 of the wall 3. An annular capillary opening 50 is present between the electrode rod 30 and the spacer means 8 over substantially the entire length L owing to the presence of the spacer means 8 around the electrode rod 30 over the entire length L. The tip 34 of the cathode 5*b* is present inside the space 4 at a distance $T_b$ of 8 mm from the inner surface 36 at the location where the electrode rod 30 passes through the inner surface 36 of the wall 3. As a result, the outer surface 15 of the wall 3 has a temperature of less than 1050 K at the area where the electrode rod 30 is connected to the lead-through 7 during stable lamp operation. The electrodes 5*a*, 5*b* are so-termed hybrid electrodes, the respective electrode rod 30 is manufactured from an alloy of tungsten with 26% rhenium by weight, while the tip 34 of the respective electrode 5*a*, 5*b* is made from tungsten (W/Re hybrid in Table 1). Alternatively, the electrodes 5*a*, 5*b* may be made from molybdenum, tungsten, rhenium, or may be composed of parts consisting of tungsten, molybdenum, and/or rhenium.

TABLE 1

| Exp. No. | Additive | Cathode material | Cathode spacer means | Number of lamps | Reject % after 200 hours | Reject % after 500 hours | Reject % after 1000 hours | Reject % after 1500 hours | Reject % after 1750 hours |
|---|---|---|---|---|---|---|---|---|---|
| 1 (ref). | LiBr | W | — | 7 | 86% | 100% | n.a. | n.a. | n.a. |
| 2 | LiBr | W | W-coil | 8 | 0% | 0% | 0% | n.a. | n.a. |
| 3* | None | W/26% Re | Mo-foil | 4 | 0% | 0% | 0% | 0% | 50% |
| 4# | None | W/26% Re | Mo-foil | 5 | 0% | 0% | 0% | 0% | 0% |

*lamp vessel fixed in reflector neck by that side of the lamp vessel in which the anode is present.
#lamp vessel fixed in reflector neck by that side of the lamp vessel in which the cathode is present.

Table 1 shows a few results relating to premature failure of 400 W DC high-pressure gas discharge lamps according to the invention as described with reference to FIG. 1 and/or 2 and reference lamps. To enhance corrosion and the effects thereof, the lamps in experiments 1 and 2 have been given lithium bromide in their fillings as an additive. The lamps in experiment no. 1 are reference lamps. The reference lamps are provided with conventional tungsten electrodes, and no spacer means are used in the reference lamps. The wall 3 has a wall load of approximately 40 W/cm$^2$ at its outer surface 15 for all lamps in Table 1. The results show that the risk of premature failure of the lamp is considerably reduced by the use of one or several measures according to the invention, compare Exp. 1 with Exp. 2 to 4.

A cathode surrounded by a molybdenum foil as the spacer means is used in Exp. 3 and 4. Exp. 3 and 4 demonstrate that the risk of premature lamp failure is smaller if the lamp vessel is fixed in the reflector neck by that side of the lamp vessel in which the cathode is present than if the lamp vessel is fixed in the reflector neck by that side of the lamp vessel in which the anode is present.

What is claimed is:

1. A high-pressure gas discharge lamp comprising:

a quartz glass lamp vessel with a space which is enclosed in a gastight manner by a wall, said wall comprising mutually opposed seals and an inner surface;

a pair of electrodes arranged opposite to one another in said space, each electrode comprising a tip and an electrode rod, and each electrode being connected to a respective current lead-through which extends through a respective seal to the exterior;

an outer surface of the wall extending between the seals, the wall having a wall load of at least 30 W/cm$^2$ at its outer surface during stable lamp operation;

a filling inside the space comprising a rare gas and halides of tin and indium, said filling comprising an alkali halide with at least one alkali ion and at least one halide ion, said alkali ion being chosen from the group formed by potassium, rubidium, and cesium, and said halide ion being chosen from the group formed by chlorine, bromine, and iodine, wherein the electrode rod of at least one of the electrodes is provided with spacer means at the area of the inner surface of the wall, whereby a capillary opening is realized which surrounds the electrode rod and is present between the electrode rod and the spacer means.

2. A high-pressure gas discharge lamp as claimed in claim 1, wherein the electrode rod is present inside the wall of the lamp vessel over a length L, characterized in that the electrode rod is provided with spacer means at least over the entire length L.

3. A high-pressure gas discharge lamp as claimed in claim 1, characterized in that the electrode rod has an envelope formed by a foil or a coil serving as the spacer means, which envelope is manufactured from a material chosen from the group formed by tungsten, molybdenum, tantalum, rhenium, and combinations thereof.

4. A high-pressure gas discharge lamp as claimed in claim 1, characterized in that the high-pressure gas discharge lamp is a DC lamp in which one of the electrodes forms a cathode.

5. A high-pressure gas discharge lamp as claimed in claim 4, characterized in that the spacer means are provided on the electrode rod of the cathode.

6. A high-pressure gas discharge lamp as claimed in claim 1, characterized in that the tip of the electrode, is manufactured from tungsten, while the electrode rod is manufactured from at least 25% rhenium by weight, with the rest tungsten.

7. A high-pressure gas discharge lamp as claimed in claim 1, characterized in that the lamp has an electrode distance D of at most 10 mm, preferably at most 3 mm.

8. A high-pressure gas discharge lamp as claimed in claim 1, characterized in that the alkali ion is potassium.

9. A high-pressure gas discharge lamp as claimed in claim 1, characterized in that the high-pressure gas discharge lamp comprises a reflector having a neck in which the lamp vessel is secured.

10. A high-pressure gas discharge lamp as claimed in claim 4, characterized in that the lamp vessel is secured in the neck of the reflector by a side in which the cathode (5*b*) is present.

* * * * *